US006116121A

United States Patent [19]

Kitt, Jr.

[11] Patent Number: 6,116,121

[45] Date of Patent: Sep. 12, 2000

[54] WRENCH WITH RESTRAINED ADJUSTABLE JAW

[76] Inventor: Frank Joseph Kitt, Jr., 11111 Kenyon Way, Alta Loma, Calif. 91701

[21] Appl. No.: 09/122,702

[22] Filed: Jul. 27, 1998

[51] Int. Cl.[7] ..... B25B 13/16

[52] U.S. Cl. ..... 81/170; 81/165; 81/155

[58] Field of Search ..... 81/170, 165, 155

[56] References Cited

U.S. PATENT DOCUMENTS

| | | | |
|---|---|---|---|
| 42,961 | 5/1864 | Noyes | 81/170 |
| 49,128 | 8/1865 | Love | 81/170 |
| 177,521 | 5/1876 | Joslyn | 81/170 |
| 193,667 | 7/1877 | Lipsey | 81/165 |
| 2,812,918 | 11/1957 | Longino | 81/170 |
| 3,710,656 | 1/1973 | Casner | 81/170 |
| 4,028,970 | 6/1977 | Pelczar | 81/165 |
| 4,446,764 | 5/1984 | Sievers | 81/170 |
| 5,222,419 | 6/1993 | Spector | 81/170 |
| 5,301,576 | 4/1994 | Nye | 81/165 |
| 5,557,993 | 9/1996 | Austin | 81/165 |

*Primary Examiner*—David A. Scherbel
*Assistant Examiner*—Lee Wilson
*Attorney, Agent, or Firm*—Patent & Trademark Services; Thomas Zack; Joseph H. McGlynn

[57] ABSTRACT

An adjustable head wrench with an elongated generally straight offset handle and a stationary jaw fixed to the handle. A movable jaw rides in a bore hole and slot within the stationary jaw with a worm gear. The worm gear in turn fits into a bore hole in the movable jaw and engages internal teeth of the movable jaw with its outer helical gears. At front end of the worm gear threads mount an external adjuster outside of the stationary jaw and wrench head. This rotatable adjuster is used to rotate the worm gear which causes the distance between the object engaging surfaces of the stationary and movable jaws to vary. To retain the adjuster in place and prevent unwanted rotation with respect to the stationary jaw, a biased ball bearing mounted in a cavity of the stationary jaw is used to engage the outer surface of the adjuster. A hole in the adjuster and a hole in the end of the threaded end of the worm gear may be aligned with each other with a pin inserted into each hole to fix the adjuster to the end of the worm gear and prevent its rotation with respect thereto.

5 Claims, 1 Drawing Sheet

FIG. 1
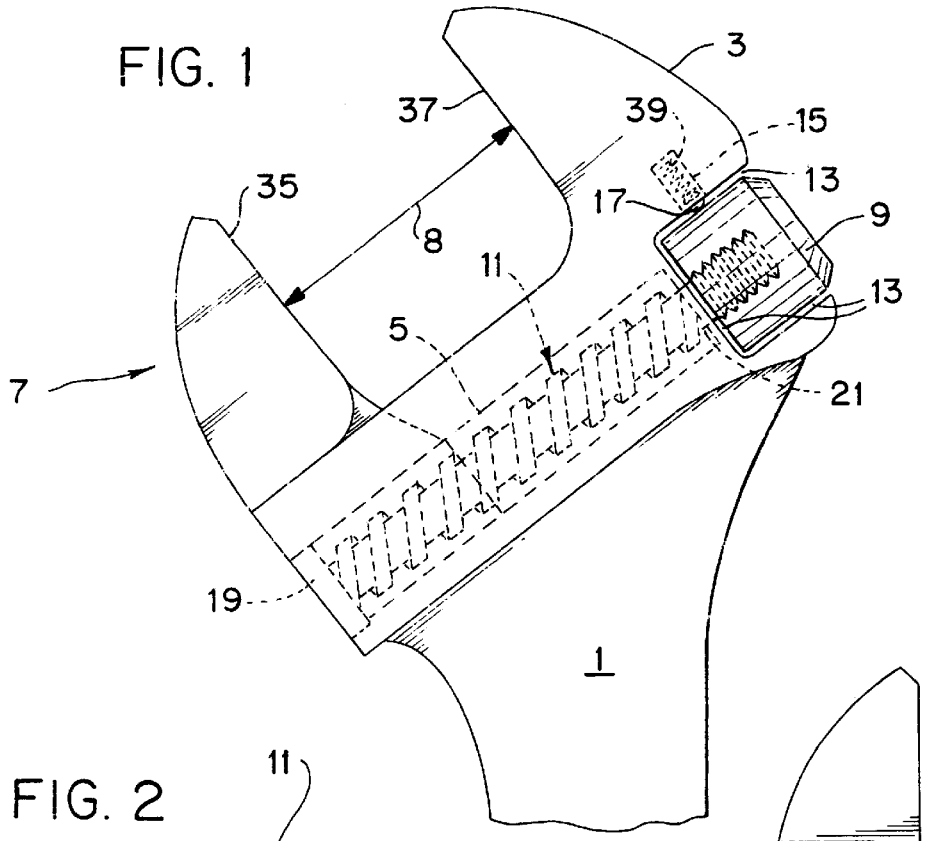
FIG. 2
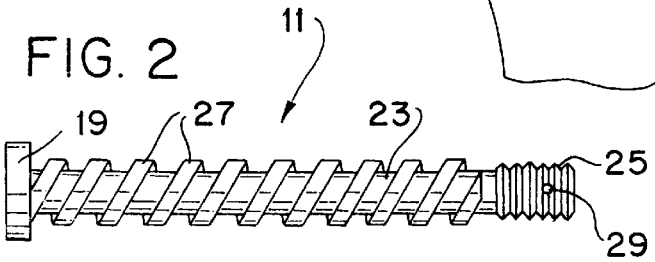
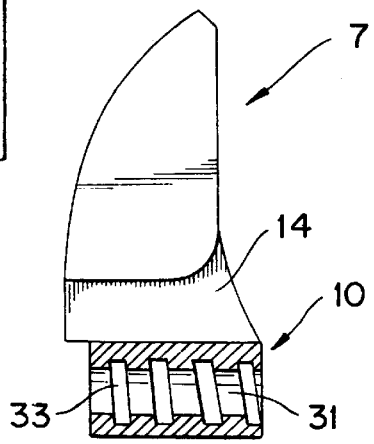
FIG. 3
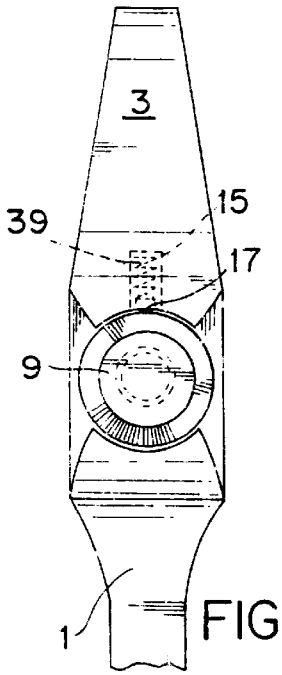
FIG. 4
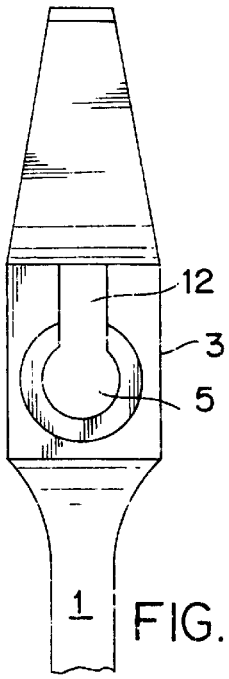
FIG. 5
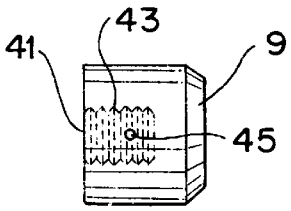
FIG. 6

WRENCH WITH RESTRAINED ADJUSTABLE JAW

BACKGROUND OF THE INVENTION

Wrenches having adjustable jaws to engage objects of different dimensions within the adjustment range are well known. In many cases a thumb rotated worm gear member rides in the front end of the main body of the wrench and also engages teeth in the jaw to be moved. As the worm gear is rotated, the jaw's teeth move over the gear carrying the joined jaw with it to adjust the opening between a stationary jaw member and the movable jaw member being moved.

When the same or several objects, like nuts or bolts, having the same dimensions are to be sequentially engaged by the movable jaws and then turned, it is not uncommon for the wrench to need adjustment between engagements. This is especially common between every 3 or 4 engagements of the wrench in such situations.

The present invention relates to an adjustable jaw wrench wherein after turning an engaged object, such as a nut or bolt, having the same engage able dimensions, it is not necessary to again adjust the span opening distance between the wrench's stationary and movable jaws.

DESCRIPTION OF THE PRIOR ART

Wrenches having adjustable jaws wherein one jaw is stationary and the other jaw moves relative thereto are well known. For example, in U.S. Pat. No. 4,028,970 to Pelczar an adjustable wrench is disclosed having a thumb operated pulley in its handle with a worm gear connected to the adjustable jaws and also to the pulley by a drive belt.

In the Sievers reference (U.S. Pat. No. 4,446,764) the adjustable wrench has an adjustment sleeve with external threads and an inner pin with a reduced diameter shear sections. This permits the pin and sleeve to be easily removed for repair or replacement.

The Nye patent (U.S. Pat. No. 5,301,576) discloses an adjustable head wrench having a threaded adjustment mechanism to clamp and lock the rotatable worm gear in place.

In the Austin invention (U.S. Pat. No. 5,557,993) a slide-type actuating mechanism in the handle made up of thumb buttons associated with slots in opposite sides of the handle engage a helical shaft and impart rotation to the shaft and to a bevel gear on the worm gear to open or close the movement of the jaws.

The present invention relates to wrench having a movable and a stationary jaw wherein an adjuster outside of the main body of the wrench on the worm gear's shaft engages a tensioned ball bearing to maintain the adjuster in place all as more fully set forth in this specification.

SUMMARY OF THE INVENTION

This invention relates to an adjustable wrench having a movable jaw and a stationary jaw. The movable jaw is moved by rotating a worm gear which is joined to an end adjuster. The adjuster's outer surface engages a ball bearing housed in the body of the stationary jaw with a biasing means forcing the ball bearing to the surface.

It is the primary object of the present invention to provide for an improved adjustable wrench having a movable and a stationary jaw that will remain in the adjusted opened position for a given sized engaged object without further adjustment for the same sized subsequently engaged object.

Another object is to provide for such a wrench wherein there is a worm gear that engages a movable jaw which gear has an adjuster fit to the gear's shaft end which adjuster is separated from and does not directly engage the body of the wrench.

These and other objects and advantages of the present invention will become apparent to readers from a consideration of the ensuing description and the accompanying drawings.

BRIEF DESCRIPTION OF THE DRAWINGS

FIG. 1 is a side view of the invention's preferred embodiment mounted on a partially shown handle.

FIG. 2 is a side view of the FIG. 1 worm gear and shaft including both shaft ends.

FIG. 3 shows a side view of the movable jaw.

FIG. 4 is a front end view of the stationary jaw and the associated adjuster and upper handle.

FIG. 5 is a rear end view of the stationary jaw and the associated upper handle portion.

FIG. 6 depicts a side view of the adjuster.

DESCRIPTION OF THE PREFERRED EMBODIMENT

FIG. 1 is a side view of the invention's preferred embodiment mounted oil the generally straight elongated wrench handle 1 whose upper portion is shown. Rigidly fixed to the handle 1 at an offset angle of about 40 degrees is the stationary wrench jaw 3 forming part of the wrench head. Movably mounted in the stationary jaw's internal bore 5 with its upper reduced dimension slot running along the bore's length (the bore 5 is shown in dotted line format) is the movable wrench jaw 7 with its depending lower portion forming the remainder of the wrench head.

External of the wrench head and its jaw 3 and handle 1, is the rotatable adjuster 9. Adjuster 9 is mounted to the threaded end of a worm gear 11. The adjuster fits within an opened U-shaped recess 13 in the jaw 3 that extends to three sides of the adjuster. This recess mount provides a degree of protection from the accidental rotation of the adjuster when the wrench is being used. Along the external surface of the worm gear 11 (see FIG. 2) there are threads that engage internal threads(see FIG. 3) in a lower through hole in the movable jaw 7.

By rotating adjuster 9 the fixedly joined worm gear 11 rotates in unison which in turn causes the threadedly engaged movable jaw 7 to either increase the spacing 8 between the two facing surfaces of the jaws 3 and 7 or to decease the same spacing, depending on the direction the external adjuster is rotated.

Within another a recess 15 in the front portion of stationary jaw 3 there is a spring biased ball bearing 17 which is forced against the outer adjacent surface of the adjuster 9 such that rotational movement of the adjuster on its worm gear shaft mount is restrained but not prevented. At the other end of the worm gear 11 there is an enlarged disk shaped end 19 (see FIG. 2) fixed on the worm gear's end that is shown in dotted line format flush with the rear surface of the stationary jaw 3. When the worm gear is rotated this end 19 rotates along with the remainder of the worm gear as the movable jaw moves relative to the stationary jaw.

The full diameter of the bore 5 within the stationary jaw 3 has a reduced diameter front area 21 which extends completely around the front end of the worm gear 11. This reduced bore diameter area 21 permits the front end of the worm gear to engage the adjuster and also provides an internal stationary jaw collar around the worm gear which reduces or eliminates any deflection of the attached adjuster when forces are transmitted to the gear. A small separation space (about 1/16 of an inch) exists around the adjuster 9 when mounted in the opened jaw's recess 13 such that the external adjuster neither touches the stationary jaw 3, the handle 1 or the movable jaw 7.

FIG. 2 is a side view of of the FIG. 1 worm gear 11 and shaft 23 including both shaft ends. The enlarged rear end 19 is fixed to the rear end of the shaft 23 and the front threaded portion 25 is fixed to the shaft's front end. In many cases the shown worm gear can be made as one unitary structure. The front threaded gear portion 25 is what fits into and engages the internal bore hole threads (see FIG. 6) in the adjuster 9.

Extending outwardly along most of the length of worm gear shaft 23 are the helical gear threads 27 which engage and mesh with complementarily shaped and spaced internal threads in a bore hole of the movable jaw 7. A small pin receiving hole 29 extends into the worm gear's at its front threaded surface 25 is used to receive a retaining pin which goes through the adjuster and is used to fixedly mount the worm gear's threaded front end to the adjuster 9.

FIG. 3 shows a side view of the movable jaw 7. The jaw's depending lower portion 10 fits within the upper opened slot and bore 5 of the stationary jaw 3. The top portion of portion 10 has an intermediate thinner section 14 which rides in the slot and the lower cylindrically shaped portion contains the lower through bore hole 31. Extending around and running the length of this bore hole are the internal threads 33. These internal bore hole jaw threads 33 mesh with and engage the external helical surface threads 27 on the worm gear 11 to move the jaw 7 relative to the stationary jaw 3 and handle when the adjuster 9 is rotated. As this happens, the spacing 8 between the two object engaging jaw surfaces is adjusted to permit different sized objects, such as different sized nuts or bolts, to be engaged by the two parallel flat facing jaw surfaces 35 and 37 shown in FIG. 1. Clearly other types of engaging surfaces could also be used such as gripping tooth surfaces.

The total length of the stationary jaw 3 extends slightly past the joining part of handle 1 (typically about ½ to ¾ of an inch) but the external surface of the movable jaw 7, when fully opened the maximum distance away from the fixed facing surface 37 (see FIG. 1), does not extend beyond the end of adjacent lower surface of the stationary jaw 3 end that seats the worm gear enlarged end 19.

FIG. 4 is a front end view of the stationary jaw 3 with the associated adjuster 9 and the upper part of the supporting wrench handle 1. A coil spring 39 (shown in dotted line format) fits into the upper closed bore cavity 15 and is retained therein with the lower free end of the spring facing towards the opened lower bore end and engaging the ball bearing 17. The amount of adjuster retaining force applied to the adjuster 9 by this spring and ball bearing combination is sufficient to normally prevent the accidental turning of the adjuster but not great enough to prevent a person using their fingers to rotate the adjuster and worm gear if desired to make an adjustment of the spacing between the two jaws.

FIG. 5 is a rear end view of the stationary jaw 3 and the associated upper handle portion 1. In this view the worm gear and adjuster is not mounted to the jaw 3. The end of the stationary jaw's internal bore 5 has an upper opened slot 12 in which the movable jaw's portion 14 (see FIG. 3) slides. The bore hole 5 communicates with the upper slot 12 along its length and has a generally smooth surface such that the lower movable jaw engaging portion 10 mating surface easily slides therein.

FIG. 6 depicts a side view of the adjuster 9 by itself. An internal bore 41 has a closed front end and an opened rear end facing towards the to be received worm gear. Internal threads 43 extend around the bore hole 41 and along its length. Threads 43 can mesh with the external front threads 25 (see FIG. 2) of the worm gear's shaft. A small hole in the adjuster 9 extends from the adjuster's surface to the bore hole and receives a pin 45, whose near end is shown. The pin 45 is received by the aligned worm gear hole 29, after the worm gear's front end is completely threaded into the adjuster, to lock the two members (9 and 11) in place with respect to each other.

In one embodiment of the invention the following dimensions were given for the described elements: the bore 5 was ½ inch in the diameter, the diameter of the reduced front bore area 21 was ¼ inch, the worm gear 11 was about 3¼ inches in overall length including its threaded front end and the slot 12 had a width of ¼ of an inch. The total maximum length 8 as measured from the ends of the two expanded jaws was 3½ inches and the stationary jaw 3 or head was offset about 40 degrees from a line running the length of the generally straight handle 1 and an intersecting line running through the length of the parallel jaw surfaces 35 and 37. This offset between the wrench's handle and object engaging surfaces allows easier access to nuts or bolts when in tight places.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An adjustable wrench comprising:

an elongated generally straight handle having a top portion;

a first stationary jaw having a length and fixedly mounted on the top portion of said handle, said stationary jaw having an object engaging surface and bore hole extending substantially the entire length of the jaw;

a worm gear mounted in the stationary jaw's bore hole and extending along the length thereof, said worm gear having outer helical teeth and a threaded end;

a second jaw having an object engaging surface facing towards the object engaging surface of the first jaw and movable with respect to said first stationary jaw, said second jaw having a through bore hole with internal threads to engage the outer helical teeth of the worm gear threads;

an adjuster fixedly mounted on the threaded end of the worm gear and rotatable therewith, said adjuster being spaced from the first stationary jaw such that there is no engagement therewith; and an adjuster retaining member mounted in said first stationary jaw and normally biased to restrain the rotation of said adjuster with respect to said stationary jaw, said adjuster retaining member consisting of a ball bearing engaging the outer surface of the adjuster and a spring mounted in the stationary jaw.

2. The adjustable wrench and adjuster as claimed in claim 1, wherein said adjuster has a threaded bore hole on which the threaded end of the worm gear is threadedly mounted.

3. The adjustable wrench and adjuster as claimed in claim 2, wherein said adjuster has a through pin retaining hole extending from the surface of the adjuster to the threaded bore hole in the adjuster and said threaded worm gear end has a hole that can be aligned with said adjuster hole.

4. The adjustable wrench and adjuster as claimed in claim 3, also including a retaining pin insertable into the pin retaining hole in the adjuster and the alignable hole in the threaded worm gear end to fix the adjuster to the worm gear.

5. The adjustable wrench and adjuster as claimed in claim 4, wherein said the object engaging surface of the second jaw when fully extended away from the object engaging surface of the first stationary jaw does not extend beyond the dimensions of the first stationary jaw.

* * * * *